United States Patent [19]

Phillips

[11] 3,951,733

[45] Apr. 20, 1976

[54] DELIGNIFICATION AND BLEACHING OF WOOD PULP WITH OXYGEN

[75] Inventor: Richard B. Phillips, Sloatsburg, N.Y.

[73] Assignee: International Paper Company, New York, N.Y.

[22] Filed: Nov. 6, 1974

[21] Appl. No.: 521,376

[52] U.S. Cl. ..... 162/65; 8/111; 162/63

[51] Int. Cl.[2] ..... D21C 9/10

[58] Field of Search ..... 162/65, 63; 8/111

[56] References Cited

UNITED STATES PATENTS 3,832,276 8/1974 Roymoulik et al. ..... 162/65

*Primary Examiner*—S. Leon Bashore
*Assistant Examiner*—Arthur L. Corbin

[57] ABSTRACT

Cellulose pulp, in the form of an alkaline, dilute aqueous slurry, is continuously bleached and delignified by oxygen dissolved and intimately dispersed and subdivided into the slurry so that no agglomerated bubbles are formed. The alkaline, dilute slurry is prepared by adding not more than about ⅔ of an oxygenated, alkaline solution to the undiluted pulp entering the system, subjecting the resulting partially diluted alkaline pulp slurry to an elevated temperature and pressure, then further diluting said partially diluted alkaline pulp slurry with the remainder of oxygenated alkaline solution.

13 Claims, 2 Drawing Figures

DELIGNIFICATION AND BLEACHING OF WOOD PULP WITH OXYGEN

BACKGROUND OF THE INVENTION

It has been conventional for many years to delignify and bleach wood pulp by the use of various chlorination procedures. These are sometimes referred to in the paper industry as the $C_DE$ stages in the 5-stage $C_DEDED$ or 6-stage $C_DEHDED$ sequences. The use of chlorine gas is not inexpensive and the removal of unused chlorine gas and the chlorine-containing by-products from the effluent streams requires expensive chemical recovery systems so as to abate stream and environmental pollution problems.

Over the years suggestions have been advanced to replace the conventional chlorine delignification and bleaching treatments by replacing the use of chlorine with oxygen. A number of processes for bleaching and delignifying pulp with oxygen have been proposed, such as Richter U.S. Pat. Nos. 1,860,432, Grangaard et al. 2,926,114 and 3,024,158, Gaschke et al. 3,274,049, Meylan et al. 3,384,533, Watanabe 3,251,730, Rerolle et al. 3,423,282, Farley 3,661,699, French Pat. Nos. 1,310,248 and 1,387,853 and articles by Nikitin et al. in Trudy Leningradshoi Lesotekb. Nickeskoi Akad. i.S.M. Korova (Transactions of the Leningrad Academy of Forestry), Vol. 75, pp. 145–155 (1956), Vol. 80, pp. 65–75, 77–90 (1958) and Bumazh. Prom., Vol. 35, No. 12, pp. 5–7 (1960). However, these processes present certain disadvantages. Many of these processes require protective agents, such as magnesium carbonate disclosed in Meylan U.S. Pat. No. 3,384,533, to prevent depolymerization of the cellulose and preservation of pulp viscosity. In addition to the imparting of scale and encrustation problems on the process equipment, the use of such chemicals has a serious disadvantage in that they present pollution abatement problems. If pollution is to be avoided, expensive recovery treatments must be employed to remove such protective agents from the effluent streams.

Roymoulik and Brown U.S. Pat. No. 3,832,276, granted Aug. 27, 1974 marked an important advance in the art because it presented a commercially feasible process for delignification and bleaching of an alkaline, dilute slurry of pulp by means of oxygen. In that process there was employed an alkaline aqueous pulp slurry of a consistency of from about 2 to 10%, having a pH of between about 9 and 14, a reaction temperature of between about 70° and 120°C., with the oxygen dissolved and intimately dispersed and subdivided into the slurry so that no agglomerated bubbles are formed and the oxygenated pulp slurry has substantially no bubbles exceeding about 1/16 inch in diameter. Conditions were employed so as to gradually decrease the pressure to which the slurry is subjected and continuously withdrawing treated slurry from the system. In an optional feature of said process, the slurry is pretreated with oxygen and alkali at an elevated temperature and pressure in a pretreatment vessel.

The aforesaid process of said U.S. Pat. No. 3,832,276, provided the paper industry with a new, efficient, continuous process which made excellent use of the chlorination towers with which conventional paper making plants were already equipped. In accordance with the present invention, I have provided an improvement over the process of said patent, making optimum use of the pressurized pretreatment stage of said process.

It is well established in the literature of oxygen bleaching that, all other variables held constant, an increase in reaction temperature will result in an increase in the extent of delignification. An article by Jan Gajdos in *Papir a Celluloza*, March, 1973, pp. 15–20, clearly demonstrates this point. When employing the conventional tower and passing the oxygenated pulp slurry upward through the tower, however, the maximum attainable temperature at the top of the tower is the boiling temperature of the alkaline pulp slurry. Since heat loss up the tower is small, the temperature at the base of the tower would also be near boiling. To use higher temperature would result in the highly undesirable consequence of flashing, and the belching of slugs of pulp slurry up the length of the tower, which cannot be tolerated.

It is, accordingly, an object of the present invention to provide a commercial low-cost continuous process for the delignification and bleaching of wood pulp, which is an improvement over the process of U.S. Pat. No. 3,832,276.

It is another object of the present invention to provide a low-cost continuous process for delignification and bleaching wood pulp which provides a practical method of achieving higher temperature in one portion of the process and, consequently, greater delignification.

It is a further object of the present invention to provide a process for delignification and bleaching of wood pulp which provides an additional benefit in the reduction of the amount of carbohydrate degradation, or viscosity loss, that accompanies delignification. This benefit is obtained as a result of the lower concentrations of NaOH that are utilized.

It is an additional object of the present invention to provide a low-cost continuous process for delignification and bleaching of wood pulp by the use of oxygen which provides an additional benefit of the invention in that, for a given retention time in the pre-retention reactor, use of the present invention allows the size of the reactor, and hence its cost, to be reduced.

Other objects will be apparent to those skilled in the art from the present specification, taken in conjunction with the appended drawings, in which.

GENERAL DESCRIPTION OF THE PROCESS

Figure 1:
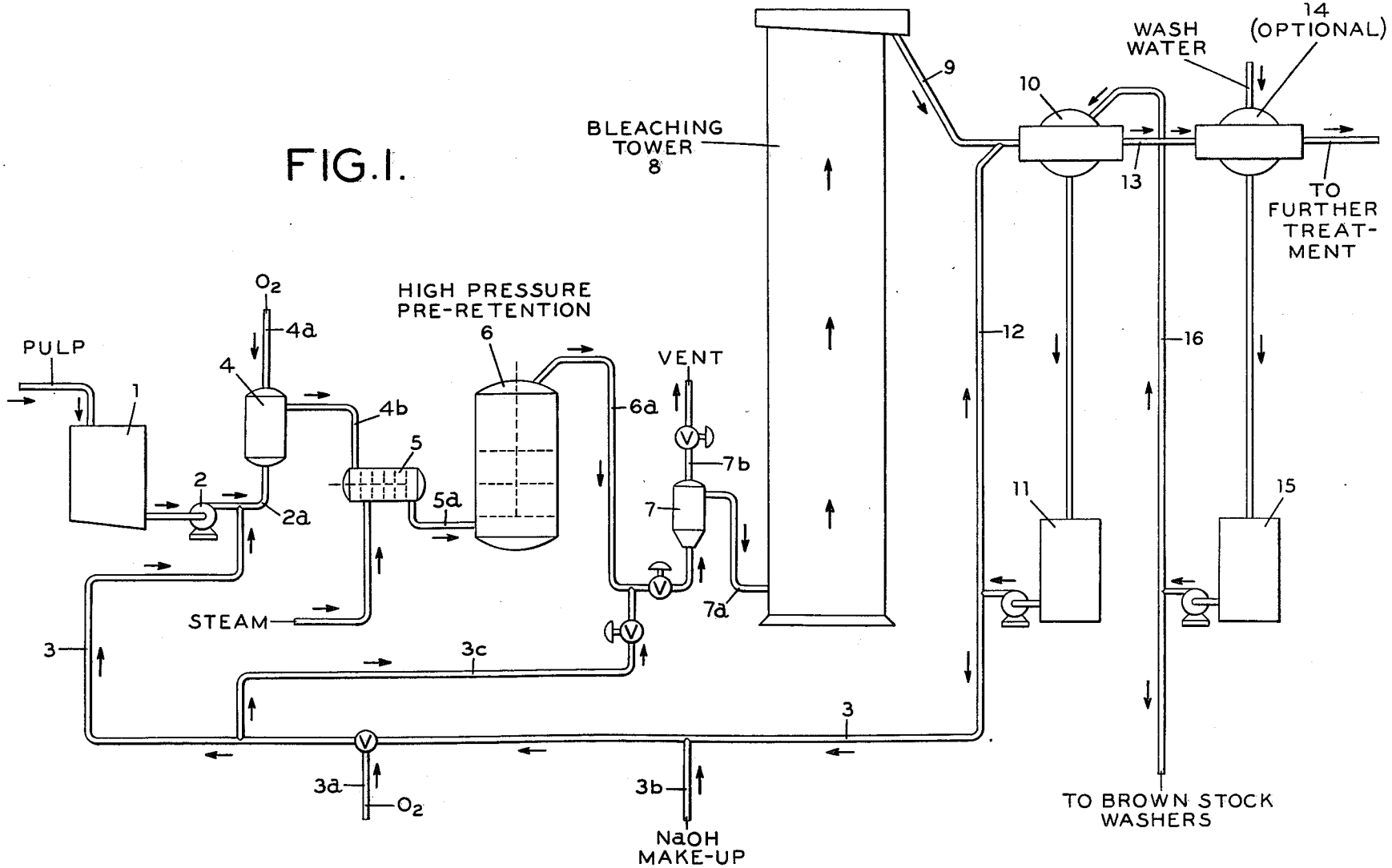
FIG. 1 is a flow diagram illustrating one embodiment of the present invention.

The present invention makes use of essentially the same apparatus and flow diagram as shown in said U.S. Pat. No. 3,832,276, with only slight modification. Thus, in the accompanying drawings, the features of difference (when compared to FIG. 2 of the patent drawings) are: alkali (NaOH) make up is provided by pipe **3*b* going into pipe 3, instead of optionally or through tank (1) as in said patent; pipe 3 introduces alkali and oxygen into pipe 2*a*, instead of tank 1. Oxygen sources 3*a* and the high pressure pre-retention vessel 6 are no longer merely optional, although the high speed pressure mixer 4 shown in attached FIG. 2 may serve the purpose of retention vessel 6** as will be described below.

Referring to FIG. 1 of the drawings, describing one form of apparatus and embodiment of the process, a pulp slurry of the desired consistency is produced by mixing in make-up tank 1. Pump 2 carries the pulp slurry of desired consistency into oxygenator or mixer 4, which is a chamber having a high-speed, high-shear mixing device, such as a Lightnin' Mixer, to incorporate and disperse oxygen along with alkali and recycled liquor from washer 10 into the alkaline pulp. Additional oxygen may be introduced into mixer 4 through inlet 4*a*. Alkali from make-up 3*b* and oxygen from 3*a* are incorporated along with wash liquor from washer 10 into pipe 3 which enters into pipe 2*a* and thence into mixer 4. The oxygenated pulp is then carried from mixer 4, through pipe 4*b* to heat exchanger 5 where steam is employed to elevate the temperature to the desired value. The heated alkaline oxygenated pulp is then passed through pipe 5*a* and subjected to pre-pressurizing chamber 6 where the pressure is momentarily elevated in that chamber, by means of oxygen pressure, for a brief period of time.

The pressure treated effluent from 6 is passed through pipe 6*a* where it is mixed with additional oxygen and alkali make-up from pipe 3*c* to reduce the pulp consistency to the desired value. The stream from pipe 6*a* is passed to vent 7 where any undissolved, undispersed oxygen is then removed from the liquid and thereafter the vented oxygenated alkaline pulp is introduced into the bottom of bleaching tower 8 by means of pipe 7*a*. At this stage care is taken that the temperature of the pulp slurry is below the boiling point. The flow of the alkaline oxygenated pulp is upward through the tower, as shown, with sufficient retention time to permit the desired bleaching and delignification to take place. Agitation of the pulp slurry in the tower is to be avoided. The initial pressure and differential in pressure during the bleaching treatment is determined by the height of the tower 8.

The effluent from the tower is then carried through pipe 9 to washer 10. The residual warm alkaline liquor recovered at the first washer is collected in container 11 and part of it is returned through pipe 3 to pipe 2*a*. Another part is returned to washer 10. The pulp from washer 10 is then carried through conduit 13 to second washer 14 where wash water is applied and the washed pulp is then carried to succeeding stages of bleaching, such as represented by chlorine dioxide treatments The effluent is collected in container 15 from which a portion is used for brown stock washing and the remainder carried through conduit 16 to be used in washing the pulp in first washer 10.

Figure 2:
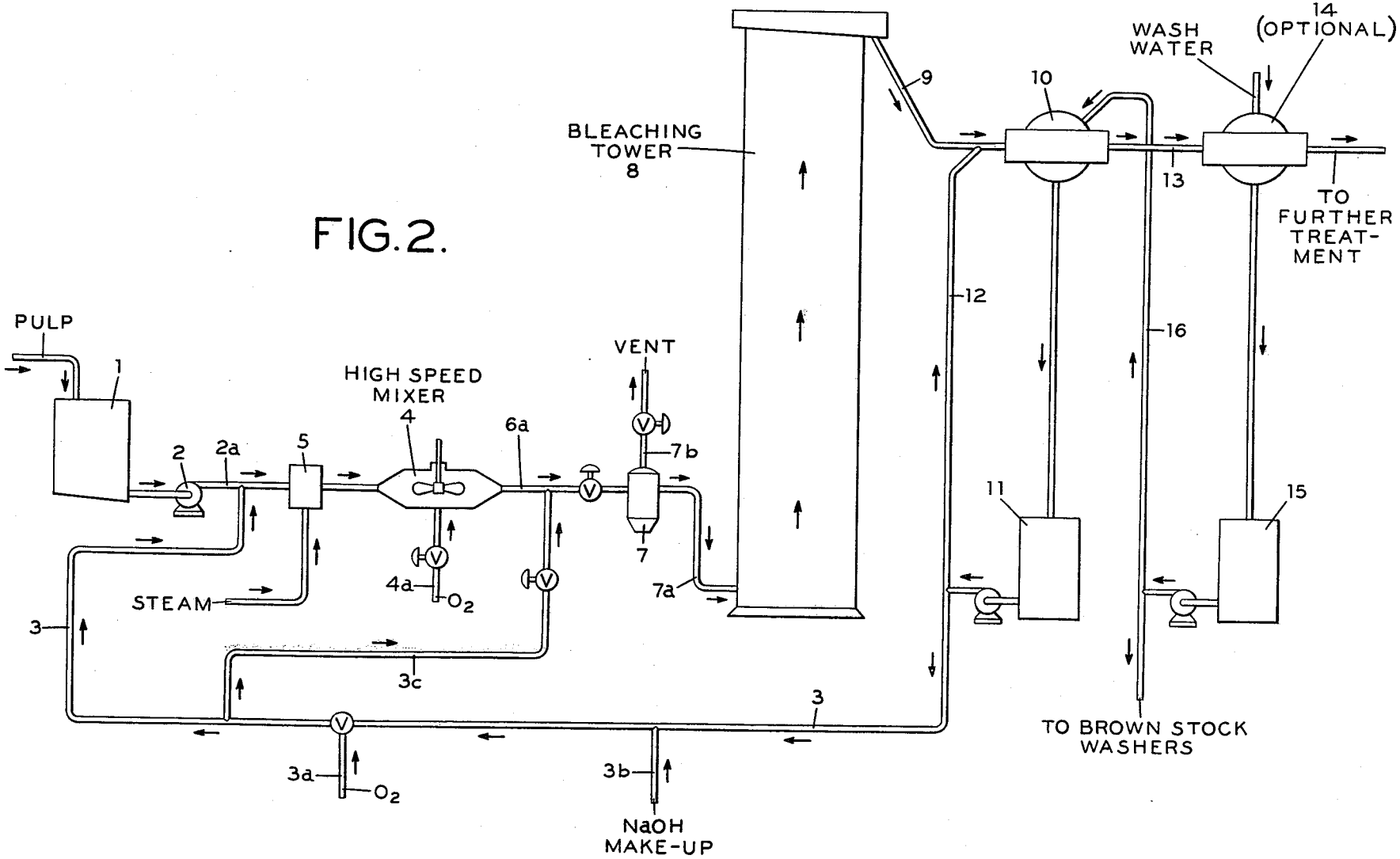
FIG. 2 is a flow diagram illustrating another embodiment of the present invention.

The embodiment of FIG. 2 and the apparatus described therein differs from that of FIG. 1 in that the pre-pressurizing chamber 6 of FIG. 1 is replaced with the high-speed mixer 4, which serves the same purpose as the pre-pressurizing chamber. The high-speed mixer 4 of FIG. 2 has an in-line high-shear mixer having the facility of readily dispersing oxygen throughout the pulp, and it is operated at elevated temperature and pressure to serve the purpose of the pre-retention chamber 6 of FIG. 1. To do this, the mixer must be equipped to withstand the pressures to which pre-retention chamber 6 will be subjected to. Upon leaving the mixer into line 6*a*, the pulp is diluted from line 3*a* with additional oxygenated alkali solution.

As can be seen from the foregoing, and the drawings, after the alkali stream has been replenished with alkali makeup 3*b* and oxygen 3*a*, it is split into two streams 3 and 3*c*. Stream 3, desirably constituting about one-half of the alkali stream, flows to dilute the incoming thick stock of pulp to a higher consistency than finally desired, such as about 4.5% consistency. The remainder of the alkali stream is introduced through pipe 3*c* to the effluent in pipe 6*a* from the high pressure pre-retention vessel 6. This will further reduce the pulp slurry consistency to a value of about 3% or any more desirable, more dilute value. This further dilution also serves to reduce the slurry temperature to below the boiling point. It is also believed to provide additional bleaching benefits in the tower. Since the volumetric flow rate of stock through the pre-retention system is diminished, the residence time is increased. Also, for the same quantity of heat used, a higher pre-retention temperature will be achieved. Also, for a given NaOH concentration in the filtrate, splitting the flow in the manner described will reduce the concentration of NaOH in the pre-retention reactor.

Desirably, the division of alkali make-up liquor flow should be regulated so that no less than about ⅓ of the total flow will be directed to the inlet thick stock, i.e., through pipe 3, with the remaining ⅔ flowing to the exit of the high pressure reactor, i.e., through pipe 3*c*. In this stage, the consistency of the pulp slurry in the high pressure pre-retention vessel 6 is desirably between about 3 and 11% by weight, preferably between about 4 and 8%. Desirably, no less than about ⅓ of the filtrate flow should be directed to the outlet of the high pressure reactor through pipe 3*c*.

In a commercial operation, it is contemplated that the temperature of the alkali make-up solution flowing into pipes 3 and 3*c* will reach an equilibrium at about 130°–140°F.

In accordance with the process of the invention, an alkaline aqueous pulp of low consistency, such as less than about 10% by weight of wood pulp, preferably between about 2 to 6% and most desirably between 3 and 4%, is employed in the tower 8. Sufficient alkali is introduced to elevate the pH of the pulp to between about 9 and 14, and preferably between about 11.5 and 12.5. When sodium hydroxide is employed, it is usually desirable that about 1 to 10 grams per liter are employed, or to constitute between about 0.1% and 1.0% by weight of the pulp slurry.

The alkaline pulp is desirably mixed with oxygen in the high-shear mixing device 4 so that no large bubbles of oxygen remain in the aqueous pulp. Desirably no oxygen bubbles exceeding about 1/16 of an inch in diameter are present. Preferably, substantially no undissolved oxygen gas is present in the pulp. Ordinarily, oxygen is introduced in an amount of between about 0.1 and 4% by weight of aqueous pulp, with amounts of about 0.2 and 0.8% being preferred for softwood, and between about 0.2 and 0.4% by weight giving best results for hardwood pulp. Any undissolved bubbles of oxygen of substantial size are to be avoided, since they cause channeling to disrupt the upward flow of pulp through the bleaching tower, thereby causing non-uniform bleaching, which is highly undesirable. Also, larger bubbles tend to agglomerate and this is to be avoided. Any undissolved bubbles should be so finely dispersed as to avoid any substantial agglomeration.

Any undissolved oxygen, such as bubbles exceeding about 1/16 of an inch in diameter, are vented from the system, at vent 7 through pipe 7*b*, before the oxygenated pulp is introduced into the bleaching tower 8.

The distribution of oxygen through the pulp is desirably achieved through any high-speed, high-shear mixing device or gas absorber. Among such devices are the "Lightnin'" In-line mixer or the Line-Blender of Mixing Equipment Co., Inc. However, any high-shear mixer may be employed, as in 4 of FIG. 2 of the drawings.

In the pre-retention vessel 6 or high-speed mixer 4, momentary pressures of up to 300 p.s.i.g., or preferably 2 to 10 atmospheres, are desirable and temperatures of between about 160° and 300°F., preferably between about 205° and 260°F., for about 1 to 30 minutes.

During the treatment in tower 8, it is desirable that the reaction temperature of the aqueous pulp slurry be between about 160°F. and its boiling point, with about 195° to 212°F. preferred. Of course, where reaction temperatures substantially in excess of 212°F. are employed, some means of providing pressure are required. For this reason, maximum reaction temperatures to be employed will be somewhat dependent on the height of the bleaching tower or initial pressure employed. The temperature should not exceed the boiling point of the pulp slurry at the pressure involved.

During the bleaching operation in tower 8, the pressure on the aqueous pulp is gradually reduced by a differential of at least about one atmosphere, with a maximum differential being about 10 atmospheres. This differential in pressure during the bleaching operation may be represented by the height of the bleaching tower, although any means for gradually and constantly reducing the pressure during treatment may be employed. Thus, a 300-foot bleaching tower provides an initial pressure of about 135 p.s.i.g. and a 40-foot bleaching tower provides an initial pressure of about 17 p.s.i.g. It is desirable that a bleaching tower be employed which is not higher than about 300 feet with the minimum height being about 40 feet.

The residence time of the aqueous pulp in the bleaching tower 8 may vary depending upon the pressure on the system and on the degree of bleaching required for the particular pulp employed. Some pulps require more drastic bleaching treatment than others. Generally speaking, from about 5 to 120 minutes is sufficient. With a higher initial pressure provided by a higher tower, the time can be reduced to a period of from about 2 minutes to 60 minutes. With a 40-foot tower, providing a pressure differential of roughly about one atmosphere, about 30 to 60 minutes, preferably about 40 minutes is satisfactory.

One of the important advantages of the process of the invention is that it permits enhancement of the viscosity of the pulp. Viscosity represents a measurement of the average degree of polymerization of the cellulose in the pulp sample, i.e., the average chain length of the cellulose. Thus, decreases in viscosity values represent the extent of depolymerization or degradation caused by the bleaching process. Excessive degradation is to be avoided since it provides undesirable physical properties in any paper made from the pulp.

Kappa No. is determined by the potassium permanganate consumed by a sample of pulp and represents a measurement of its retained lignin content. The higher the Kappa No., the less bleached and delignified is the pulp. By comparing Kappa Nos. of samples before and after bleaching treatment, one can obtain an evaluation of the extent of delignification which has taken place.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES I THROUGH X

Employing apparatus illustrated by FIG. 1 of the appended drawings, pilot plant studies were made and the conditions employed and the results obtained are set forth in Table I below. In these tests comparisons were made between conventional operation of the system in accordance with the process of U.S. Pat. No. 3,832,276, and the "split flow" features of the present invention. Thus, Examples I, II, VI, and VII employ the "full flow" technique, with all of the oxygenated alkaline solution going through the pre-retention pressure reactor 6 and are marked "conv" in said Table I. The remaining examples employ the split flow system of the present invention with some of the alkali and oxygen by-passing the pre-retention pressure reactor 6. These examples are marked "split" in said Table I.

In the Table, "UB" represents unbleached pulp. Oxygen flow is represented by the oxygen introduced by a Lightnin' mixer at 4 and by a high-shear mixer at 3*a* in the drawings.

Table I.

Operating Data for Low Consistency Oxygen Bleaching Pilot Plant

| Example No. | I | II | III | IV | V | VI | VII | VIII | IX | X |
|---|---|---|---|---|---|---|---|---|---|---|
| Type of Pulp | DISSOLVING PULP | | | | | PAPER GRADE PULP | | | | |
| Production Rate (Tons/Day) UB Pulp | 1.27 | 1.21 | 0.95 | 1.03 | 1.11 | 0.86 | 0.86 | 0.80 | 1.15 | 0.86 |
| Type of Operation | conv | conv | split | split | split | conv | conv | split | split | split |
| Pre-Retention Reactor(6) | | | | | | | | | | |
| Consistency, % | 3.8 | 3.5 | 4.4 | 4.7 | 4.7 | 2.9 | 2.9 | 4.8 | 4.9 | 4.1 |
| Temperature, °F. | 202 | 208 | 288 | 222 | 233 | 208 | 212 | 253 | 249 | 241 |
| Pressure, Psig. | 102 | 101 | 100 | 100 | 99 | 100 | 101 | 102 | 97 | 101 |
| NaOH Conc., g/l. | 1.6 | 1.8 | 1.6 | 1.2 | 1.0 | 4.5 | 4.9 | 1.4 | 2.2 | 3.4 |
| Bleaching Tower(8) | | | | | | | | | | |
| Consistency, % | 3.8 | 3.5 | 3.2 | 3.4 | 3.4 | 2.9 | 2.9 | 3.0 | 3.6 | 2.9 |
| Temperature, °F. | 202 | 196 | 198 | 193 | 199 | 202 | 209 | 201 | 213 | 199 |
| Make-up NaOH | | | | | | | | | | |
| Flow, lb./Hr. | 3.13 | 2.96 | 2.28 | 2.00 | 2.00 | 4.77 | 5.46 | 1.93 | 3.96 | 4.36 |
| % on UB Pulp | 2.9 | 3.0 | 2.9 | 2.4 | 2.2 | 6.6 | 7.6 | 2.92 | 4.13 | 6.06 |

Table I.-continued

| Operating Data for Low Consistency Oxygen Bleaching Pilot Plant | | | | | | | | | | |
|---|---|---|---|---|---|---|---|---|---|---|
| Example No. | I | II | III | IV | V | VI | VII | VIII | IX | X |
| Oxygen Flow, cc/min. | | | | | | | | | | |
| Lightnin' Mixer | 290 | 290 | 290 | 290 | 290 | 1000 | 1000 | 290 | 1000 | 1000 |
| High Shear Mixer | 1360 | 1360 | 1360 | 1360 | 1360 | 1500 | 1500 | 1360 | 1360 | 1500 |
| Brightness, % Elrepho | | | | | | | | | | |
| Unbleached | 37.0 | 35.9 | 39.2 | 36.0 | 39.2 | 27.8 | 27.6 | 27.1 | 27.6 | 27.6 |
| Bleached | 48.3 | 45.7 | 49.8 | 52.2 | 48.1 | 38.3 | 40.9 | 38.8 | 40.8 | 42.4 |
| A Brightness | 11.3 | 9.8 | 10.6 | 16.2 | 8.9 | 10.5 | 13.3 | 11.7 | 13.2 | 14.8 |
| Permanganate No./KAPPA | | | | | | | | | | |
| Unbleached | 5.9 | 6.6 | 5.1 | 5.7 | 5.2 | 19.3 | 18.3 | 16.6 | 16.3 | 17.5 |
| Bleached | 3.7 | 4.1 | 2.8 | 2.6 | 3.1 | 12.7 | 11.0 | 10.5 | 9.9 | 10.3 |
| % Reduction | 37.3 | 37.9 | 45.1 | 54.4 | 40.4 | 34.2 | 40.0 | 36.7 | 39.3 | 41.1 |
| Viscosity, ½ % CED | | | | | | | | | | |
| Unbleached | 32.0 | 33.4 | 22.7 | 33.4 | 32.1 | 46.7 | 46.2 | 38.1 | 36.2 | 41.2 |
| Bleached | 12.4 | 13.1 | 10.4 | 12.7 | 19.7 | 26.3 | 23.5 | 25.5 | 23.0 | 24.2 |
| % Reduction | 61.3 | 60.8 | 54.2 | 62.0 | 38.6 | 43.7 | 49.2 | 33.1 | 36.5 | 41.3 |

In the runs set forth in Table I, since it is natural that each method gives a range of levels of delignification, it is necessary to compare the methods at a given level of permanganate number or kappa number reduction. Thus, for dissolving pulp, Examples I and II show that, in total flow through the pressured pre-retention chamber 6, permanganate number reduction levels of 37–38% resulted in a reduction of viscosity of about 60–61%. By using split flow, Example V shows that a similar level of delignification (40.4% reduction in permanganate number), the viscosity was reduced by only 38.6%. Moreover, Examples III and IV show that, using split flow, the permanganate number can be reduced by 45–54% before the viscosity is reduced to the same extent noted in full flow through said chamber 6.

A similar trend, perhaps not as pronounced, is noted with the paper grade pulp. Examples VI and VII show that full flow gave kappa number reductions of 34.2% and 40.0%, with corresponding viscosity losses of 43.7% and 49.2%. Using split flow of the present invention, the lower level of delignification was achieved with only 33.1% loss of viscosity (Example VIII) while at the higher level of kappa reduction, Examples IX and X show the consistent superiority of the split flow method of the invention.

EXAMPLES XI THROUGH XIII

Table II below shows several additional examples of desirable operating conditions embodying the present invention. In these examples, the unbleached pulp initially was at 10% consistency, diluted to high pressure reactor 6 consistency with alkali a 4.8 g./l. and at a temperature of 140°F. Outlet of the reactor was at a temperature of 203°F. In these examples, Example XIII is a comparison example showing total flow through the pre-retention reactor 6 as in that process of U.S. Pat. No. 3,832,276.

Table II

| Example No. | Consistency in High-Pressure Pre-Retention Reactor (6) | Temp. (°F) in High-Pressure Pre-Retention Reactor (6) | NaOH Conc. in High-Pressure Pre-Retention Reactor (6) (g./l.) | Fraction of flow through Tower (8) not passing through Pre-Retention Reactor (6) |
|---|---|---|---|---|
| XI | 5% | 245 | 2.4 | ½ |
| XII | 4% | 220 | 3.1 | ⅓ |
| XIII | 3% | 203 | 4.0 | 0 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In a continuous method of bleaching and delignifying cellulose pulp comprising the steps of preparing a cellulose pulp slurry in an oxygenated alkaline aqueous solution, said slurry having a reaction temperature of between about 160°F. and its boiling point, a consistency of from about 2% to about 10% by weight, and having a pH of between about 9 and 14, said alkaline aqueous solution being oxygenated by dissolving and intimately dispersing oxygen into said alkaline aqueous solution so that no agglomerated bubbles are formed, continuously introducing said slurry into a vessel, subjecting the slurry to an initial pressure and thereafter gradually reducing that pressure, without subjecting the slurry to any substantial agitation, so that there is a pressure gradient of between about 1 and 10 atmospheres between the initial pressure and final pressure, and continuously withdrawing treated slurry from said vessel, the improvement which comprises subjecting said pulp slurry and not more than about ⅔ of said oxygenated alkaline aqueous solution to a pre-treatment in a pressurizing vessel at a temperature of between about 160° and 300° F. and pressure of up to about 300 p.s.i.g. and mixing said pressurized slurry with the remainder of said oxygenated alkaline aqueous solution.

2. In a continuous method of bleaching and delignifying cellulose pulp comprising the steps of preparing a cellulose pulp slurry in an oxygenated alkaline aqueous solution, said slurry having a reaction temperature of between about 160°F. and its boiling point, a consistency of from about 2% to about 10% by weight, and having a pH of between about 9 and 14, said alkaline aqueous solution being oxygenated by dissolving and intimately mixing oxygen into said alkaline aqueous solution so that no agglomerated bubbles are formed, continuously introducing said slurry into the lower region of a vertically elongated tower, flowing said slurry upwardly through said tower without any substantial agitation, while maintaining a pressure gradient of between 1 and 10 atmospheres between the point of introduction of said slurry into said tower and the point of withdrawal of said slurry from said tower, and continuously withdrawing treated slurry from the upper region of said tower, the improvement which comprises subjecting said pulp slurry and not more than about ⅔ of said oxygenated alkaline aqueous solution to a pre-treatment in a pressurizing vessel at a temperature of between about 160° and 300°F. and pressure of up to about 300 p.s.i.g. and mixing said pressurized slurry with the remainder of said oxygenated alkaline aqueous solution.

3. A continuous method in accordance with claim 1, wherein at least about ⅔ of said alkaline aqueous solution is subjected to said pre-treatment.

4. A continuous method in accordance with claim 2, wherein at least about ⅓ of said alkaline aqueous solution is subjected to said pre-treatment.

5. A continuous process according to claim 1, wherein the consistency of pulp slurry subjected to said pre-treatment shall be between about 3 and 11%.

6. A continuous method in accordance with claim 1, wherein the consistency of the pulp slurry is between about 2 and 6% by weight.

7. A continuous method in accordance with claim 1, wherein the amount of oxygen introduced is between about 0.1 and 4% by weight of the pulp slurry.

8. A continuous method in accordance with claim 1, wherein the temperature in said treatment vessel subsequent to said pre-treatment is between about 195° and 212°F.

9. A continuous method in accordance with claim 2, wherein the tower is not higher than about 300 feet and the oxygenated slurry is introduced near the bottom of said tower.

10. A continuous method in accordance with claim 2, wherein the residence time of the slurry in said tower is between about 2 and 120 minutes.

11. A continuous method in accordance with claim 1, wherein the amount of oxygen introduced is between about 0.2 and 0.4% by weight of the pulp slurry.

12. A continuous method in accordance with claim 1, wherein the temperature during said pre-treatment is between about 16° and 300°F.

13. A continuous method in accordance with claim 1, wherein the pressure during said pre-treatment is between about 2 and 10 atmospheres.

* * * * *